United States Patent [19]
Phillips
[11] 4,260,105
[45] Apr. 7, 1981

[54] RAILROAD TIE PLATE AND CORRECTABLE SHIM

[76] Inventor: Albert A. Phillips, Rte. 1, Box 56A, Byars, Okla. 74831

[21] Appl. No.: 127,995

[22] Filed: Mar. 4, 1980

[51] Int. Cl.³ ..... E01B 9/44; E01B 9/10
[52] U.S. Cl. ..... 238/303; 238/287; 238/304; 238/306; 238/310; 238/372
[58] Field of Search ..... 238/264, 281, 283, 287, 238/303, 304, 306, 307, 308, 310, 338, 342, 372, 373

[56] References Cited

U.S. PATENT DOCUMENTS

| | | | |
|---|---|---|---|
| 954,538 | 4/1910 | McKee | 238/303 |
| 956,499 | 4/1910 | McKee | 238/303 |
| 1,001,879 | 8/1911 | Moorhead et al. | 238/304 X |
| 2,008,946 | 7/1935 | Cooper | 238/304 |
| 3,469,784 | 9/1969 | Campbell et al. | 238/287 |

*Primary Examiner*—Randolph A. Reese
*Attorney, Agent, or Firm*—Browdy and Neimark

[57] ABSTRACT

A railroad plate and connectable shim is disclosed for fastening railroad tracks over ground having a flat or raised topography in an economically feasible manner. The instant system provides a base plate with a sloping grooved channel for reception of the lower flange of a rail to be held in place in combination with a trapezoidal shim to insure the proper cant of the rail over the various topographical areas of the country. The instant base plate, trapezoidal shim, rail and railroad tie are all fastened via a set of screws which are angled towards the center of gravity of the rail.

2 Claims, 3 Drawing Figures

RAILROAD TIE PLATE AND CORRECTABLE SHIM

FIELD OF INVENTION

The present invention relates to improvements in transportation, and more particularly to improved railroad track beds.

BACKGROUND OF INVENTION

As a consequence of the high escalating cost of diesel fuel, the railroad industry has found it necessary to pull heavier and longer loads of rolling stock over its rail systems. These systems in most states have become somewhat deteriorated from lack of proper maintenance and sometimes are passable only at greatly reduced speed. Recently questions into the safety of transporting hazardous materials by rail have been raised as a result of the seemingly many accidents caused by these antiquated rail systems and the magnitude of a potential disaster when a hazardous cargo spills during its passage through highly populated areas.

Rail fastening devices have been available to the train industry almost from the time of its inception. One such rail-fastening system is set forth in U.S. Pat. No. 874,535, Dec. 24, 1907, issued to Percival. In this system a rectangular cushion is fitted to tightly engage the rail and provide a recess in which the bottom portions of the lugs or spikes engage the rail to hold the same firmly in position. This cushion prevents the lug heads on the outside from leaving the flanges of the rail during heavy use. The material of the cushion is taught as being elastic in nature, such as wood.

A second U.S. Pat. No. 914,093, issued to Weston in 1909, discloses a tie plate system to prevent the "creeping" of the rail over the plate and substructure. Succinctly stated, this is accomplished by use of a tie plate with oppositely disposed shoulder formations adapted to grip the edges of the rail base when the rail is seated. Another 1909 U.S. Pat. No. 935,679, issued to McWethy, discloses a rail tie of concrete having adjustable rail chairs to conform to the grade of the road bed. These rail chairs have a seat or chair cut out for the base flange of the rail. The yokes holding the rail chairs to the ties are adjustable to conform to the extent of torque exerted on the rail chairs in relation to the gage of the road. In U.S. Pat. No. 954,538, issued to McKee, a rail is held in place by spikes situated on an incline and passing through a tie plate to allow the rail to have a fixed quantum of play.

A railroad tie block is disclosed in U.S. Pat. No. 1,076,577, issued to Hollis, which comprises a grooved wooden block channelled for reception of the bottom portion the rail to be held. The flanges of the screws provide a means to secure the rail and also provide easy repair or removal of the tie block portion. In U.S. Pat. No. 1,443,275, issued to Radelet in 1922, a system is disclosed for the fastening of a rail to a tie member. A bearing plate is provided to receive the conical head of a holding screw and thereby firmly secure the bottom flange of a rail pressed beneath the bearing plate. An angular holding clip is disclosed in Wesolik, U.S. Pat. No. 1,454,090 (1922) for securing the bottom flange of a rail. The latter is inserted in the angularly raised portion of the clip and likewise the tie transversing the underneath side of the clip. A 1935 patent to Boyce, U.S. Pat. No. 2,018,658, disclosed a tie plate having a recessed area for the seating of the bottom flange of a rail and underneath extending ribs for securing the tie plate to a wooden railroad tie.

A system utilizing a holding or fastening clip is disclosed in U.S. Pat. No. 3,004,715 (1961). A special securing bolt having both horizontal and vertical serrations is provided to insure the bonding of the bolt to the railroad tie. The disclosed tie plate has a grooved portion for the reception of the bottom flange of the rail. A pad of rectangular configuration is available if desired to be situated between the tie plate and tie. This pad may be made of fiber or insulated material and can be used in single track section where insulating qualities are important. An insulating and cushioning pad is disclosed in U.S. Pat. No. 3,268,170 (1966) which is mounted on a cross tie and supported on a concrete bed. The rail is held in place via a steel bearing plate having the resilent pad thereunder completely encompassing and thereby insulating the rail to be traversed by a subway train.

A patent issued to Campbell et al., U.S. Pat. No. 3,469,784 (1969), discloses that the prior art generally desired to contour the rails to the conical shape of the wheel slope. The problem of "shelling" the outer rail in a curved track was addressed by increasing the outer-curve rail to a 2 in 40 slope to thereby distribute the wheel load over a much greater top area of the rail. This increase in the cant is accomplished by a tappered insert which is anchored by spikes also passing through the rail plate and passing in a perpendicular manner into the rail tie. Another recent U.S. Pat. No. 4,141,500 (1979), issued to Gragnani, discloses a railway tie plate having a least one rib to locate the rail and two arches under which parts of rail clips are driven parallel to the rib.

The aforementioned prior art generally discloses problems and solutions to various problems concerning the longevity of a track system. The instant prior art does not show or suggest a system as herein disclosed and set forth in the appended claims.

SUMMARY OF INVENTION

The instant invention provides a system whereby the railroad industry can easily and feasibly install and repair their rail systems with respect to both straight and curved tracks, and this is accomplished in an economical manner to provide a safer track bed.

It has been determined that a cant of approximately 1° is preferred for the placement or replacement of straight rails, and a greater cant is needed around curves. Until now, there has not been a convenient system for combining an uneven channelled base plate with an uneven shim to provide for easy repair of the rails possessing a predetermined cant, and provide a cushioned or "floating" rail. This invention meets that need and also provides a system to secure the rail in a much more economically feasible manner.

The instant disclosed system also provides a more economical means to attach the bottom flange of a rail to a base plate and railroad tie by means of eliminating one fastening means from the outside of the rail base plate. Thus, this invention provides an article of manufacture to enable the railroads to repair or situate new tracks into proper position in an economical manner to prevent "shelling" of the rails as a result of passage of the conical shaped steel wheels of the railroad.

This invention relates to an improvement in the use of canted railroad base plates in combination with a trapezoidal shim in order to provide the railroad industry with a more uniform article of manufacture to use for securing both flat and curved sections of railroad track.

An object of the invention is to overcome deficiencies in the prior art such as noted above; a further object is to improve rail beds, another object is to provide a "floating" or cushioned rail.

Another object of this invention is to provide a feasible rail fastening system for the railroad industry so that a proper rail cant may be obtained easily and economically on both flat and curved sections of track of a rail system.

Another object of this invention is to provide a system for fastening railroad tracks which can be handled by workmen in the field without need to resort to complicated measurements to ascertain the proper slope of a rail.

Yet another object of this invention is to provide a feasible and economic system for fastening tracks in a subway system in order to maintain a uniform slope of both underground and elevated track sections.

It has been found in nearly all cases of securing a rail to allow passage of trains thereover, that four basic entities are necessary: (1) a railroad tie, (2) a railroad base plate, (3) a rail and (4) a fastening means to secure the bottom flange of the rail to the railroad tie. In situations where the track is curved, it has been found necessary to provide a shim intermediate the base plate and the railroad tie. It is of paramount importance that the bottom flange of the rail be held in a secure fashion to avoid the "backing out" of the fastening means which not only loosens the track but will allow water to penetrate to the railroad tie and cause premature rotting of the same. The instant invention provides such a means for straight and curved rail.

For a better understanding of the invention, as well as the above and other objects and the nature and advantage of the instant invention, a possible embodiment will now be described with reference to the attached drawing, it being understood that this embodiment is merely exemplary and not limitative.

DETAILED DESCRIPTION OF INVENTION

Figure 1:
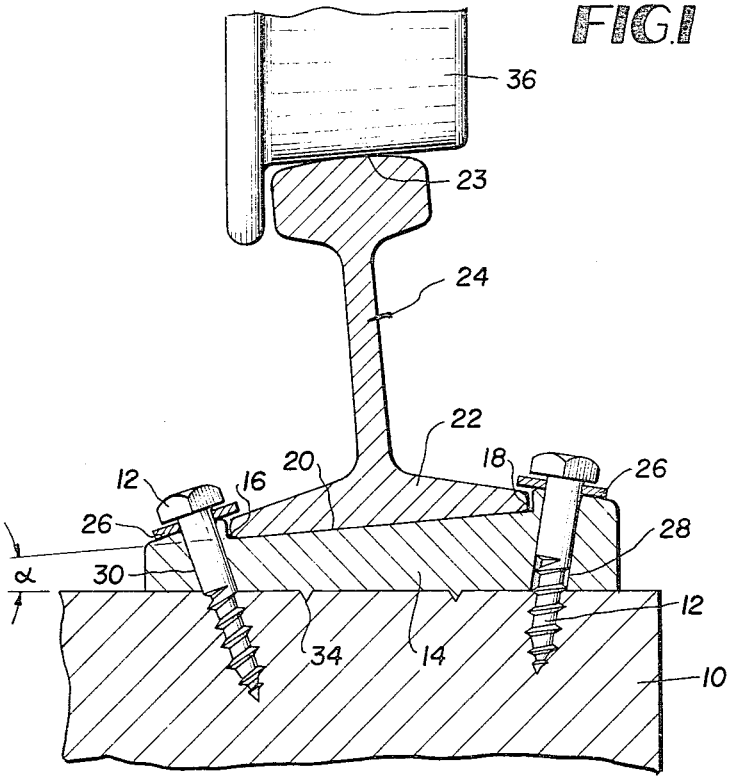
FIG. 1 is a side view of a rail being held in this system over country which is flat in nature.

FIG. 1 shows a railroad tie 10 which is normally made of wood. Upon this tie 10 is secured by toed-in screws 12 a base plate 14 provided with a central rectangular groove 20 in which the base or lower flange 22 of the rail 24 rests, the width of the channel 20 and its height each being $\frac{1}{8}''$ greater than, respectively, the width and height of the rail base 22. It can be seen from inspection that the rail 24 is canted to an angle depicted as $\alpha$, which is normally 1° during the traversal of the rail over straight track. Thus, the thickness of base plate 14 at the outside corner 18 of the channel 20 is greater than the thickness of its inside corner 16. Washers 26 are disposed above the shoulder of the lower flange 22 of rail 24 to tightly hold the plate 14 and to prevent the rail from leaving the channel 20. The plate 14 is suitably $7\frac{1}{2}''$ to 8" by 12" to $12\frac{1}{2}''$.

One purpose of the 1° cant is to improve contact between the crown 23 of the rail 22 and the train wheel 36. At 1° cant, the weight of the train is more evenly spread over the crown of the rail, and provides contact over about 95% of the crown 23. As a result the wheels and track wear more evenly and the train is better balanced; shelling of the rails and cupping of the wheels the outside and two screw holes 30 on the inside of such plate 14 for the passage therethrough of the three screws.

Figure 3:
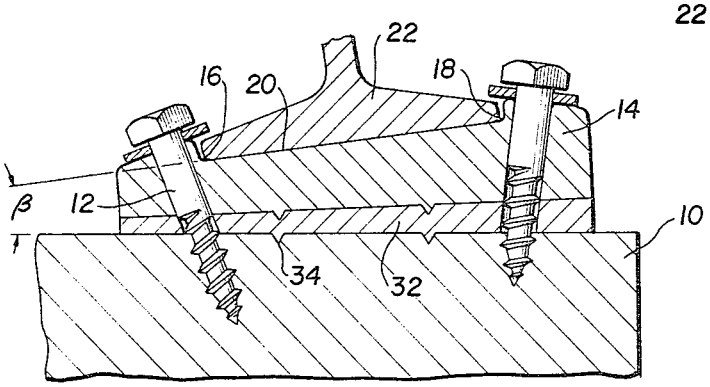
FIG. 3 is another side view showing the track being held in a curved or hilly area of the country.

FIG. 3 shows the embodiment of FIG. 1 adapted for use where a greater degree of cant $\beta$ is necessary, e.g. where the track curves. In this case a trapezoided shim 32 is placed under the base plate 14 and the angulation of the shim 32 added to angle $\alpha$ of the base plate gives the desired total angle $\beta$ to the plane of of the tie 10.

The lowermost disposed member of the present rail securing system, namely the tie 10, may be a conventional railroad railroad tie of 6" height and 8" width which is usually made of wood treated with organic chemicals such as a heavy mineral oil or cresote to prevent its rotting in place. As previously mentioned, it is desirable to maintain a 1° cant when the rail is straight to provide a 95% match between the crown of the rail 24 and the wheel 36. It is for this reason that the rail 24, when held without the use of a shim, should be slightly canted or angled. In order to provide this particular cant, the base plate 14 is provided—with its channel 20 for reception of the lower flange 22 of the rail—so that distance of the rail to the tie 10, once the rail is placed in a secured manner, is greater on the outside of the rail flange then on the inside of the rail. For instance, in measuring the distance in perpendicular line from the bottom of the rail flange 14 to the tie, a distance of approximately 10/16th of an inch is preferably present directly below the outside lower rail flange adjacent corner 18. In contrast, the inside flange of the rail will possess a measured distance of only 7/16ths of an inch from the lowermost portion of the rail flange 22 adjacent inside corner 16 to the railroad tie 10. This will secure the rail over relatively flat land to provide the proper cant for the conical treads of the steel railroad wheels 36.

By use of this system, it has been found that a securing means, which is most preferably a screw, is necessary to hold the bottom of the rail flange 22 in the channel 20 of the base plate 14 with the inside portion of the rail adjacent corner 16 having two such fastening means but the outside portion of the rail flange adjacent corner 18 having only one such securing means for a single base plate 14 of size roughly equal to the width of the tie 10. As a result of using this uneven base plate 14, it has been found that the lower flange 22 of the rail may be held securely in the base plate 14 by means of the securing means possessing a large head, it being understood that a $\frac{1}{8}''$ gap is provided between the bottom of the washer 26 and the top of the flange 22 as described below.

When these large headed securing screws 12 are driven into position through the base plate 14 and into the tie 10, on both sides of the rail, they are angulated at the level of the upper surface of plate 14 so that if they were longer than they are, they would meet along a line in the ground just therebeneath. In other words, the fastening screws are toed-in towards a longitudinal center plane extending below the rail.

A washer system including the washers 26 are preferably used in order that the bottom of the washer 26 will hold the top shoulder of the lower rail flange in the groove 20; when the rail flange 22 contacts the washer 26 and expansion due to heat occurs, the washer 26 will turn while the screw 12 remains firmly fixed. The screws contemplated in this system will normally be $\frac{3}{4}''$d. by 5 and $\frac{7}{8}''$ long with the head being $1\frac{1}{2}''$ across and $\frac{3}{8}''$ thick; if desired, a washer of $2\frac{3}{4}''$d., $\frac{1}{4}''$ thick with 1" hole is used to engage the top shoulder of the bottom flange of the rail. The screw holes 28 and 30 are desirably $\frac{7}{8}''$d.

The channel 20 has a width which is desirably $\frac{1}{8}''$ greater than the width of the base 22 of the rail 24. Also the channel 20 has a height which is suitably $\frac{1}{8}''$ greater than the height of the base 22 at its corners so that a $\frac{1}{8}''$ gap normally exists between the bottom of the washer 26 and the top of the base 22. These gaps give the rail room to move slightly as the train wheels 36, which are spaced 8–60 feet apart, pass thereover. As each wheel passes from a unit of the present system, the rail springs back to its original position. The overall effect is to provide a cushion or "floating" rail which reduces wear and provides automatic cant. These gaps also give room to permit rail expansion during hot weather.

Figure 2:
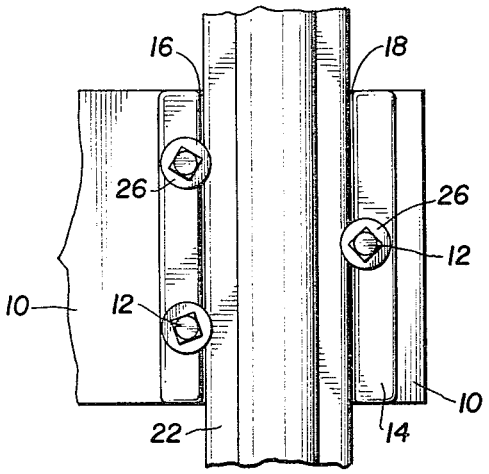
FIG. 2 is a top plan view showing the base plate.

In the manufacture of the base plate, the holes 28 and 30 are provided for passage of the fastening screws 26 therethrough to engage the wooden railroad tie 10 as shown in FIG. 2. It is also desirable that the bottom surface of the rail base plate 14 and of the shims 32 contain serrated edges 34 to engage the very top of the railroad tie to prevent movement of the same as the heavy freight or passenger train cars move over the top flange of the secured rail 24.

In situations where the rail is disposed on a curve, centrifugal force changes the angulation of the wheel 36 relative to the crown of the rail 24; when this occurs it is important to raise the cant of the rail so that the crown of the rail will more accurately engage the conical tread of the car's steel wheels 36. When such is desired, i.e. on curves, the shim 32 of trapezoidal configuration, is placed between the base plate and railroad tie with the higher edge of the shim located at a point beneath the outside corner 18 of the base plate 14, and the smaller dimension of the trapezoidal shim 32 will be directly under the inside coner 16 of the base plate.

Thus, using insertable shims 32 of varying size (only two sizes of shims are necessary, e.g. 1/16" and $\frac{1}{8}''$ lift) with a single sized base plate, provides a railroad with the ability to maintain relatively constant surface contact between the wheel 36 and the crown of rail 36 even around curves, i.e. the angle of the shim 32 compensates for the inevitable shift of the wheels 36 when the train traverses the curve, so as to restore the desired cant of 1°. The shims 32, of course, possess the same two aligned holes 30 for the securing means on the inside portion of the rails and one hole 28 on the outside portion of the rails, all of which will be congruent with the holes of the standard sized base plate 14.

By means of the use of the present base plate, trapezoidal shim, fastening screws and washers, the railroad industry is able to economically provide itself with a fast track which is safer, longer lasting, and will require considerably less maintenance over the life of the track. Conversely, older tracks may be more conveniently repaired utilizing the combination of this article of manufacture without the necessity to replace the solid ties lying beneath and perpendicular to the existing rails.

Besides the advantages noted above, the shim 32 and base plate 14 with the $\frac{1}{8}''$ clearance between rail base 22 and the walls of the groove 20, together with a second clearance between the rail base 22 and the washer 26, provide a cushion for the rails which, in turn, improves safety and speed. The common 8" wide tie is retained and the rail is held to its using only three screws. On a straight track, as shown in FIG. 1, the side friction is minimized as the wheels push the track outwardly, the springing of the rail outwardly about $\frac{1}{8}''$ in the channel 20 serving to simultaneously cushion the ride and automatically correct the cant. On curves as shown in FIG. 3, the weight of the train is better distributed over the crown of the rail.

It will be obvious to those skilled in the art that various changes may be made without departing from the scope of the invention and the invention is not to be considered limited to what is shown in the drawings and described in the specification. For example, the system may be used for electrified rail systems in conjunction with a layer of insulating material placed beneath the plate 14 of the shim 32.

What is claimed is:

1. An article of manufacture for securing a train rail to a series of wooden ties, wherein the rail has an upper flange for the passage thereover of train wheels and a lower flange for securing of the rail to the railroad ties, comprising:

a plurality of rail supporting base plates, each said base plate being disposed over a railroad tie and each having a length approximately the width of the railroad tie upon which it is disposed, each said base plate having a bottom wall, at least one upper wall, and a sloped rectangular groove disposed in the upper wall and defined by a pair of groove sides and a groove bottom, said sloped rectangular groove extending the length of said base plate and having a width which exceeds the width of the lower flange of the rail so that the rail rests in said sloped groove upon said base plate with gaps between the sides of the lower rail flange and the sides of the rectangular groove, the sloped rectangular groove having a depth which exceeds the height of the lower flange of the rail adjacent the sides of the groove;

each said rail supporting base plate being thicker beneath one side of the rectangular groove than beneath the other side of the rectangular groove to provide the slope of said groove, said base plates being placed on the railroad ties such that the outside of each base plate is higher than the inside thereof;

said base plates each having one hole passing therethrough along the outside thereof and two holes passing therethrough along the inside thereof, said holes being adapted to receive therethrough securing screws for holding the base plates to the wooden railroad ties;

a plurality of trapezoidally shaped shim plates, at least one said trapezoidally shaped shim plate being located immediately beneath a base plate over a railroad tie in a location where the rail is curved, each said trapezoidally shaped shim plate having three holes therein aligned with the three holes of the overlying base plate, the highest elevation of each shim plate being beneath the outside of the overlying base plate with the smaller elevation being beneath the inside of said base plate;

securing screws passing through the holes in said base plates and said trapezoidally shaped shim plates and for engaging with the underlying railroad ties, said screws being elongated and being disposed at a towed-in angle with the heads of said screws spaced from said base plates; and means to permit the rail to move slightly both horizontally and vertically when a train passes thereover comprising a washer disposed between the head of each said screw and said base plate to extend over the top of the bottom flange of the rail thereby leaving a gap between the bottom of said washer and the top of the lower flange of the rail, said washer being freely movable between said screw head and said base plate, whereby said washer will turn while said screw remains firmly fixed during longitudinal movement of said rail, said means to permit the rail to move also comprising said gaps between the sides of said groove and the sides of the lower rail flange.

2. An article in accordance with claim 1, wherein said base plates also have means projecting from the bottom walls thereof to prevent movement of the base plates relative to the railroad ties.

* * * * *